United States Patent [19]

Fechter et al.

[11] 4,318,670

[45] Mar. 9, 1982

[54] SCREW PUMP FOR CONVEYING WASTE WATER AND THE LIKE

[75] Inventors: Leonhard Fechter, Kulmbach; Günter Nudinger, Aarbergen, both of Fed. Rep. of Germany

[73] Assignee: Passavant-Werke Michelbacher Hutte, Fed. Rep. of Germany

[21] Appl. No.: 109,814

[22] Filed: Jan. 4, 1980

[30] Foreign Application Priority Data

Jan. 29, 1979 [DE] Fed. Rep. of Germany ..... 2903277

[51] Int. Cl.[3] ..... F02C 3/02

[52] U.S. Cl. ..... 415/72; 415/203

[58] Field of Search ..... 415/71, 72, 73, 74, 415/203, 205

[56] References Cited

U.S. PATENT DOCUMENTS

| | | | |
|---|---|---|---|
| 107,900 | 10/1870 | Groat | 415/73 |
| 605,888 | 6/1898 | Maginot | 415/72 |
| 815,224 | 3/1906 | Sjostrom | 415/74 |
| 2,027,015 | 1/1936 | Bell | 415/74 |
| 2,795,193 | 6/1957 | Linscott | 415/74 |

*Primary Examiner*—Louis J. Casaregola

*Attorney, Agent, or Firm*—Woodford R. Thompson, Jr.

[57] ABSTRACT

A pump for conveying waste water and the like embodying a substantially vertically arranged drivable screw mounted for rotation within a fixed pipe having an inlet at the lower end thereof and an outlet at the upper end thereof. At least one upstanding baffle is mounted below the screw and in the vicinity of the inlet with at least the upper portion of the baffle extending in the direction of conveyance.

9 Claims, 7 Drawing Figures

SCREW PUMP FOR CONVEYING WASTE WATER AND THE LIKE

BACKGROUND OF THE INVENTION

This invention relates to a screw type pump and more particularly to such a pump which is used for conveying waste water or the like by means of a substantially vertical screw which is mounted for rotation within a fixed pipe that surrounds the screw and defines a conveying channel, with the pipe having an inlet opening at the lower end thereof and a discharge opening at the upper end thereof.

Vertical screw pumps have an advantage over bucket wheels and inclined screw pumps in that the expense of providing a separately designed complicated structure is eliminated. That is, the vertical screw pump is in the form of a completely constructed unit which only requires that it be suspended into the waste water channel or tank from which the liquid is to be conveyed. In addition, vertical screw pumps reach their maximum capacity at a speed of from 300 to 500 rpm and at the same time do not require a costly gearbox. While centrifugal pumps operate at still higher speeds, there is the inherent danger that the activated sludge flocs will be broken down. To achieve a useful efficiency, inclined screw pumps must have a gradient of approximately 40° and a shaft diameter which is at least 50% of the screw diameter. With vertical screw pumps, on the other hand, the shaft can be extremely thin since the shaft is not subjected to transverse forces. This is particularly advantageous since it increases the discharge capacity. Also, with a vertical screw pump, the lower shaft bearing can be eliminated so that the inlet flow is not impeded.

SUMMARY OF THE INVENTION

We have discovered that with a conventional vertical screw pump of the type mentioned above there is still room for improvement in the efficiency of operation thereof. Accordingly, the purpose of our invention is to provide a vertical screw pump in which the efficiency of operation thereof is improved. To accomplish this, the screw pump according to our invention is provided with at least one baffle having a surface below the screw and in the vicinity of the inlet opening, with the upper portion of the baffle extending in the direction of conveyance or flow. This baffle surface has the effect of preventing rotary motion of the flow. The liquid thus flows towards the screw without twisting and the differential in speed is increased as the flow is taken up by the screw. This results in an increase in the quantity of liquid conveyed and thus improves the efficiency of operation.

Preferably, a small distance is provided between the top edge of at least one baffle and the lower end of the screw. We have found that in this manner neither appreciable depositions or "maceration" of the pollutants occurred and that the stabilizing effect of the baffle surface remained intact.

In another embodiment of our invention we provide a plurality of baffle surfaces which are surfaces arranged so as to extend radially in a star-like formation. These baffle surfaces extend below an extension of the screw shaft and it is advantageous to surround at least the upper portions of the baffles with an annular member which is connected to the pipe surrounding the screw, so that the flow to the screw is from the lower face of the pipe.

A side inlet is also possible within the scope of our invention. The pipe, for this purpose, terminates in a base having a side inlet opening. To guide the inflowing waste water flow more effectively, the inlet opening can be connected to an inlet channel. A particularly high conveying capacity will result if this inlet channel is arranged tangentially in such a way that the inlet flow and the direction of rotation of the screw are in the same direction. In this case, it has been found to be particularly advantageous if the inner wall of the inlet of the flow channel is extended as a baffle surface approximately up to a vertical axis which is an extension of the axis of the screw. In this manner, the horizontal flow deflection is 270° while, at the same time, the wall friction helps to eliminate the tendency of the flowing stream to twist. Subsequently, the flow is deflected upwards by the baffle member which provides for an optimum increase of the speed differential when the flow is taken up by the screw. We have found that this results in an increased efficiency of approximately 8%.

Volume control, covering a range of from 10 to 100% should preferably take place on the inlet side of the pump. In accordance with our invention this is accomplished by providing a regulating unit, such as a penstock, located on the inlet for varying the cross sectional area of the inlet. Where the inlet is located on the lower face of the pipe a double-penstock may be employed. It has been found that volume control on the discharge side of the pump reduces efficiency considerably. The reason for this is attributable to the fact that waste water already conveyed is restrained from being discharged, thus subjecting it to a blockage.

To add to the advantages obtained at the inlet side of the pump we improve the discharge side by providing the upper end of the pipe with a tangential discharge channel. In this case, the channel is preferably arranged so that the waste water is discharged in the same direction as the direction of rotation of the screw. Accordingly, a free running flow is obtained which can be utilized to provide an additional improvement in efficiency of approximately 2%.

A further advantageous feature of our invention is that the screw is double-threaded. A balanced screw is thus obtained wherein the sole bearing is the upper bearing which is extremely simple of design or construction. A further increase in efficiency can be obtained by providing a guiding cone below this bearing which deflects the waste water whereby it flows freely into a horizontal direction.

DESCRIPTION OF THE DRAWINGS

Apparatus embodying features of our invention is illustrated in the accompanying drawings, forming a part of this application, in which.

DETAILED DESCRIPTION

Figure 1:
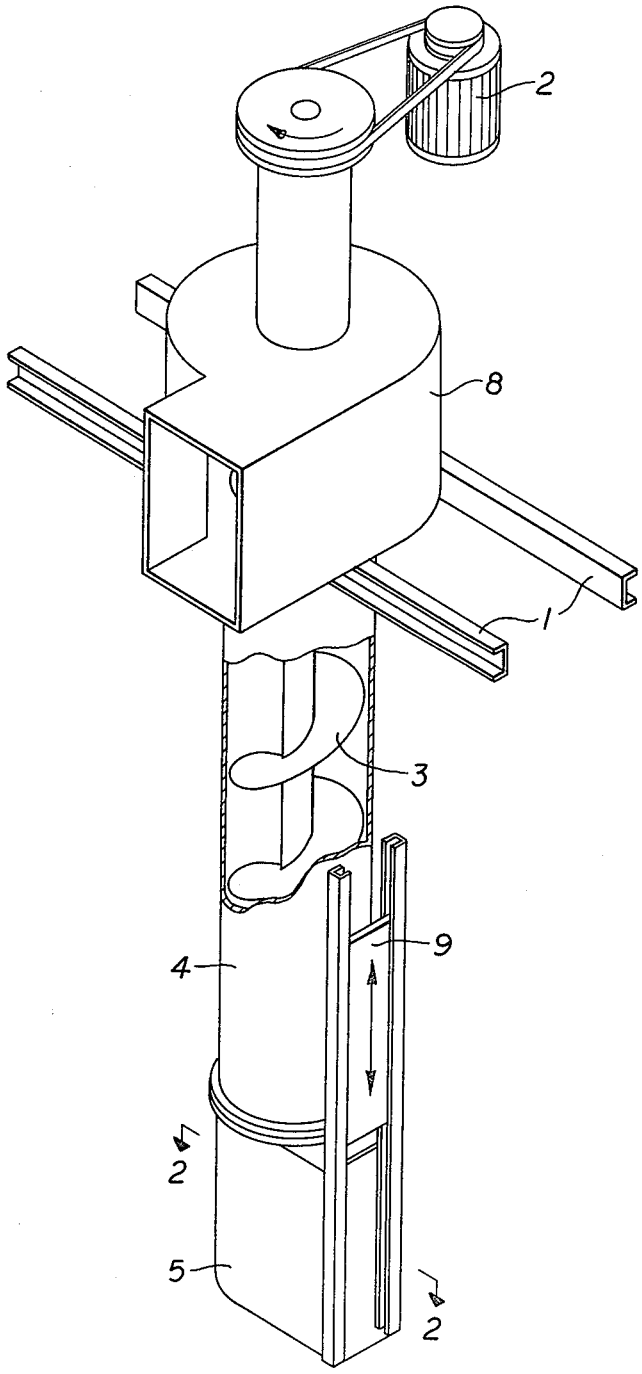
FIG. 1 is a perspective view partly broken away and showing a fragment of the screw.

Referring now to the drawings, we show in FIG. 1 a mounting support 1 on which a screw pump according to our invention is suspended. The screw pump is provided with a motor 2 which is operatively connected in driving relation with a screw 3 having a twin-row of threads passing upwards. Surrounding the screw 3 is a pipe 4 which defines a conveying channel therebetween.

Figure 2:
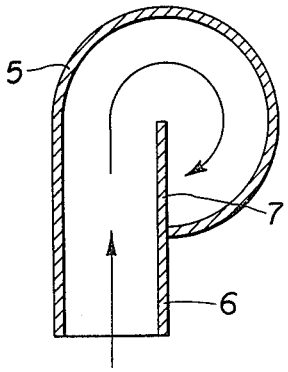
FIG. 2 is a sectional view taken generally along the line 2—2 of FIG. 1 showing the inlet.
Figure 3:
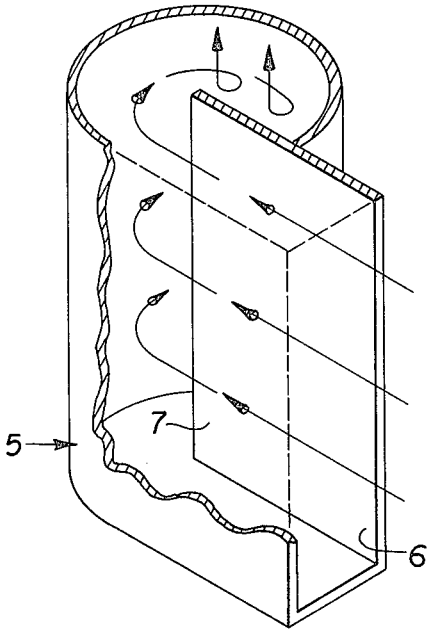
FIG. 3 is a perspective view, partly broken away showing schematically the flow conditions within the inlet.

Mounted at the lower end of the pipe 4 is a tangential inlet housing 5 having an inner wall 6, as shown in FIG. 2, which extends forward to a vertical axis which is an extension of the axis of the screw 3 to define a baffle plate 7. The upper edge of the baffle plate 7 terminates 5 mm below the lower end of the screw 3. As shown in FIG. 2, the incoming flow is subjected to a horizontal deflection of 270° and is then deflected approximately 90° in an upward or vertical direction as shown in FIG. 3.

Figure 4:
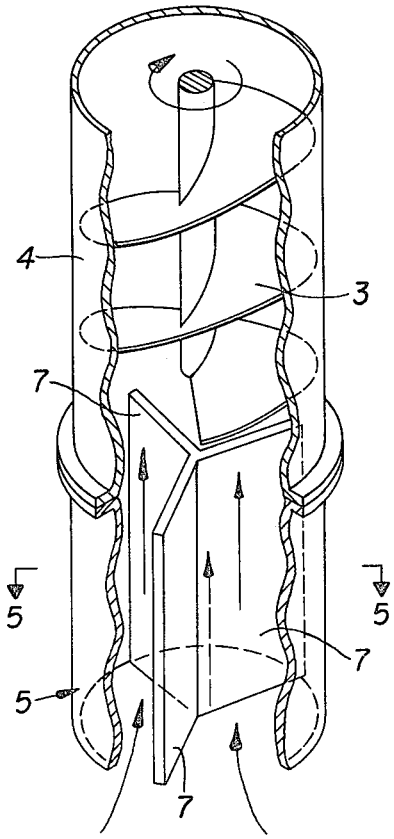
FIG. 4 is a fragmental view, partly broken away, showing a modified inlet.
Figure 5:
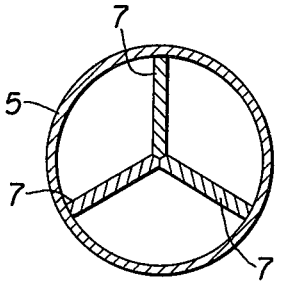
FIG. 5 is a horizontal sectional view taken generally along line 5—5 of FIG. 4.
Figure 7:
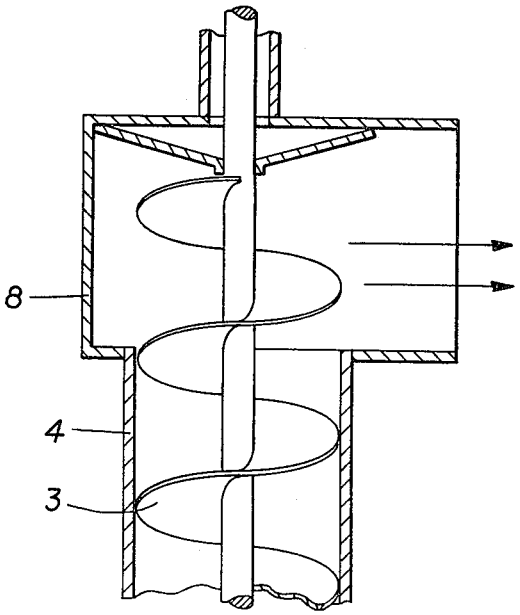
FIG. 7 is a fragmental sectional view showing a guiding cone for the discharge section.

FIGS. 4 and 5 illustrate an inlet on the lower face of the pipe 4 in which the baffle plates 7 extend parallel to the axis of the pipe 4 and are arranged so as to extend radially in a star-like formation and symmetrically within the inlet housing 5.

Figure 6:
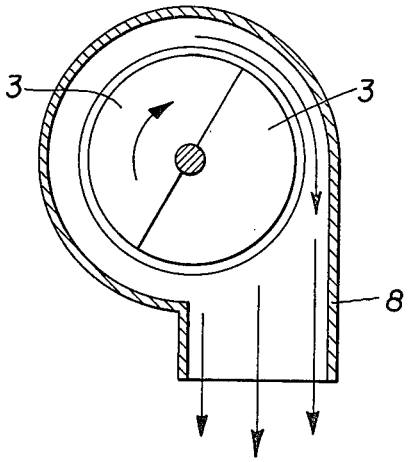
FIG. 6 is a horizontal sectional view through the discharge section.

A discharge housing 8 is provided at the upper end of the pipe 4. As shown in FIG. 6, the discharge housing 8 may be of a tangential design.

Volume control for the screw pump is, in the case of FIG. 1, effected by means of a penstock 9, and in the case of FIGS. 4 and 5, by means of a conventional twin-diaphragm valve which is not shown.

What we claim is:

1. A screw pump for conveying waste water and the like having at least one substantially vertically arranged drivable screw with a fixed pipe surrounding the screw and defining a conveying channel and with the pipe having a side inlet opening at the lower end thereof and a discharge opening at the upper end thereof, the improvement in that an upstanding baffle member is mounted below the screw with at least the upper portion of said baffle member being located at one side of said side inlet opening and extending radially in the direction of conveyance and with the pipe surrounding said screw having a closed floor.

2. A screw pump as defined in claim 1 in which said baffle member extends radially and inwardly toward a vertical axis which is an extension of the axis of said screw to define a tangential inlet channel so that the waste water flows in the same direction as the direction of rotation of the screw.

3. A screw pump as defined in claim 2 in which said tangential inlet channel is located in front of the side inlet opening.

4. A screw pump as defined in claim 3 in which said baffle member is located in a plane which defines an extension of the inner wall of said inlet channel.

5. A screw pump as defined in claim 1 in which a regulating unit is mounted at the inlet opening for varying the cross sectional area of said inlet opening.

6. A screw pump as defined in claim 1 in which said screw is double-threaded.

7. A screw pump as defined in claim 1 in which said pipe surrounding the screw extends upwards to a discharge housing having a discharge opening at a side thereof which extends tangentially therefrom to a discharge conduit.

8. A screw pump as defined in claim 7 in which said discharge conduit extends in a direction which corresponds to the direction of rotation of the screw.

9. A screw pump as defined in claim 7 in which a guiding cone surrounds the shaft of the screw adjacent the upper end of the discharge housing.

* * * * *